US006041855A

United States Patent [19]

Nistor

[11] Patent Number: 6,041,855

[45] Date of Patent: Mar. 28, 2000

[54] HIGH TORQUE PRESSURE SLEEVE FOR EASILY DRILLABLE CASING EXIT PORTS

[75] Inventor: Radu Nicolae Nistor, Edmonton, Canada

[73] Assignee: Halliburton Energy Services, Inc., Houston, Tex.

[21] Appl. No.: 09/065,522

[22] Filed: Apr. 24, 1998

[30] Foreign Application Priority Data

Apr. 23, 1998 [CA] Canada ..... 2235865

[51] Int. Cl.[7] ..... E21B 19/16

[52] U.S. Cl. ..... 166/50; 166/55.1; 166/242.1; 166/242.6; 175/79

[58] Field of Search ..... 166/50, 298, 55.1, 166/242.1, 242.6; 175/79, 80, 81, 82

[56] References Cited

U.S. PATENT DOCUMENTS

| | | | |
|---|---|---|---|
| 3,811,500 | 5/1974 | Morrisett et al. . | |
| 4,415,205 | 11/1983 | Rehm et al. . | |
| 5,038,862 | 8/1991 | Giroux et al. . | |
| 5,458,209 | 10/1995 | Hayes et al. . | |
| 5,462,120 | 10/1995 | Condouin | 166/380 |
| 5,615,740 | 4/1997 | Comeau et al. . | |
| 5,875,847 | 3/1999 | Forsyth | 166/313 |

OTHER PUBLICATIONS

Nickle's New Technology Magazine, vol. 5, No. 10, Dec. 1997, pp. 6–8.

*Primary Examiner*—David Bagnell
*Assistant Examiner*—Chi H. Kang
*Attorney, Agent, or Firm*—Terrence N. Kuharchuk; Patrick H. McCollum; Eugene R. Montalvo

[57] ABSTRACT

An apparatus for providing a high torque pressure sleeve for easily drillable casing exit ports. A joint of tubular casing with a pre-formed window in the wall thereof has a tubular sleeve fixedly attached to the exterior of the tubular casing covering the window. The interior surface of the sleeve is sealed to the exterior of the tubular casing on opposite sides of the window. In use, the joint of the tubular casing is run down to the depth of interest in the earth wellbore and the window is oriented with respect to the formation of interest at the depth. The joint of tubular casing is then cemented in place, after which a whipstock is lowered into the wellbore, oriented and anchored therein. The assembly automatimuly fixes the axial and circumferential oriention of the whipstock within a surrounding casing joint and holds the assembly in place. A drilling assembly is lowered into the casing and a lateral bore is drilled off the whipstock through the window and the pressure sleeve and into the surrounding formation.

15 Claims, 5 Drawing Sheets

HIGH TORQUE PRESSURE SLEEVE FOR EASILY DRILLABLE CASING EXIT PORTS

BACKGROUND OF THE INVENTION

1. Field of Invention

This invention relates generally to apparatus used for drilling branch wells from a main well, and more specifically to apparatus for drilling lateral wells from cased wells, for the purpose of producing oil and gas from subsurface formations.

2. Description of the Prior Art

Conventional technology provides for the drilling of a well from the surface to a predetermined depth beneath the surface into a subterranean formation containing hydrocarbon reserves. Most conventional wells have traditionally been substantially vertical. However, current technology now provides for the drilling of deviated or non-vertical wells using directional drilling technology.

Directional drilling technology also allows for secondary, branch or lateral wells to be drilled laterally from the primary or main well. A primary well including more than one secondary or lateral well is typicaly referred to as a multilatal well. Lateral wells are often drilled and produced through a port in the casing of the primary well. The port typically comprises a window pre-cut or pre-formed in a section of the steel casing string. The casing window system is available in various oilfield tubular material grades. Typically, the completed casing window is overwrapped with composite materials, such as fiberglass.

U.S. Pat. No. 4,415,205, issued on Nov. 15, 1983, to Rehm et al, discloses a method and apparatus to complete triple branch wells using separate drill and casing templates. In Rehm et al a special casing is used having a series of vertically separated windows, or easily penetrable exit ports, corresponding to the desired location of branch wells. The windows are filled with fiberglass.

U.S. Pat. No. 5,458,209, issued on Oct. 17, 1995, to Hayes et al, discloses a method and system for drilling lateral wells with respect to a main well which is cased by a casing string. In Hayes et al there is disclosed the use of a pre-cut opening or window in the steel casing, covered by fiberglass, which can be easily drilled.

Use of the prior art systems of Rehm et al and Hayes et al, in which a per-cut or pre-formed opening is filled or covered with an easily drillable material such as fiberglass, has proven to be less than completely satisfactory. The fiberglass material simply cannot withstand the high pressures fequently encountered in oil and gas wells, sometimes being in excess of 10,000 psi. In addition, the exposed fiberglass can be damaged easily when installing the casing string in a well.

In U.S. Pat. No. 5,615,740, issued Apr. 1, 1997, to Comeau et al and assigned to the assignee of the present invention, there is disclosed a system for use in high pressure environments typical in oil and gas drilling. Comeau et al utilize a pre-cut window in the casing which is covered with easily drillable material, such as fiberglass. In addition, a retrievable pressure sleeve is fixed within due interior of the casing, adjacent the window in the casing. The sleeve is pressure sealed to the interior of the casing and the window space between the sleeve and the fiberglass wrap filled with fluid to provide protection from pressure damage to the fiberglass window covering. Once the casing has been cemented in place, the sleeve can be retrieved to the surface and drilling through the window can commence.

When a typical window opening in the casing is sheathed with a composite material, such as fiberglass, as thought in the prior art, the torque strength of the resulting composite is low for application in a high torque environment often encountered when installing a casing string into a well. A high torque as referred to herein can be considered to be torque greater than approximately 10,000 foot-pounds. The addition of the internal sleeve, as thought by Comeau et al, does not add significant strength for applications requiring high torque. Also, the internal sleeve presents the requirement for an additional trip into the well so that the internal sleeve can be removed to the surface before drilling out the window.

As a result, there remains a need in the industry for an improved apparatus and method for drilling lateral wells in high pressure environments using a casing having an easily drillable exit port and having the capability to withstand torque.

SUMMARY OF THE INVENTION

The present invention relates to an apparatus for providing a high torque pressure sleeve for easily drillable casing exit ports. The apparatus includes a sleeve mechanically fixed externally to the casing over the casing window. The sleeve is constructed of an easily drillable material and fixed to the casing in a manner to allow torque to be applied to the casing string so as to reduce the risk of torsion failure to the window joint when installing the casing string in a well.

BRIEF DESCRIPTION OF THE DRAWINGS

Embodiments of the invention will now be described with reference to the accompanying drawings, in which.

DETAILED DESCRIPTION OF THE PREFERRED EMBODIMENT

Figure 1:
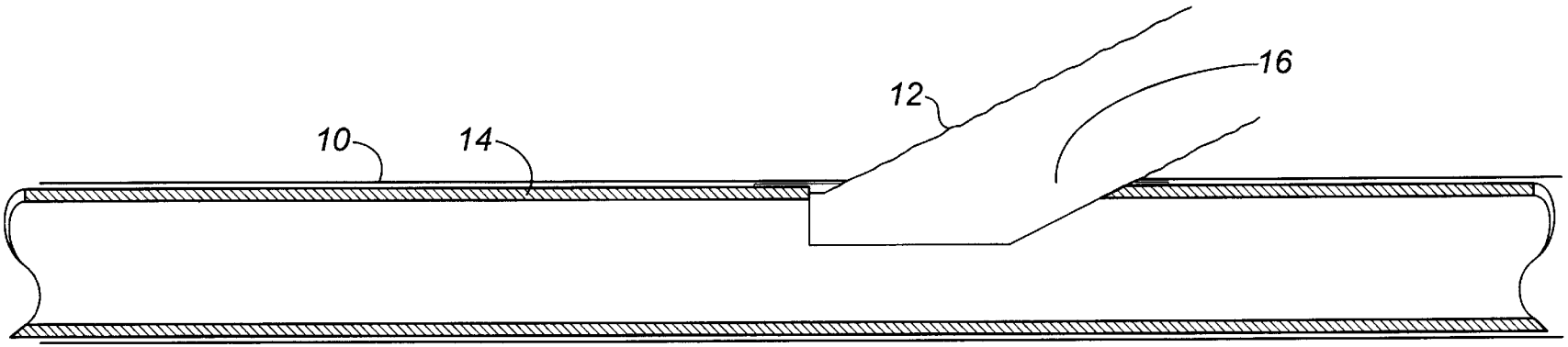
FIG. 1 is a longitudinal sectional view of a junction of a primary well and a secondary well, wherein the primary well contains a casing string defining a lateral window or drill out port.

The present invention is directed to an apparatus and method for providing a pressure sleeve for easily drillable casing exit ports capable of withsanding the high torque common in the drilling environment. Referring now to FIG. 1, there is shown a wellbore of the type comprising a primary well 10 and at least one secondary well 12. The primary well 10 can be comprised of a substantially vertical well, such that the longitudinal axis of the well 10 is substantially perpendicular to the ground surface, or may be a deviated well, such that the longitudinal axis is not substantially perpendicular to the ground surface. Further, the primary well 10 may not extend directly to the surface, but may be comprised of a lateral or horizontal well which intersects and is in communication with a further vertical or deviated well which then extends to the surface for production of the well.

The primary well 10 is cased such that the primary well 10 contains a tubular, steel casing 14 which is set in place using cement (not shown). The casing string 14 is formed within the primary well 10 using conventional techniques known in the industry The casing string 14 is illustrated having a pre-cut or pre-formed window or exit port 16 disposed therein. The window 16 provides an exit port for the drill bit to drill the secondary well 12 in a conventional manner, such as that illustrated in U.S. Pat. No. 5,615,740, which is incorporated herein by reference.

Figure 2:
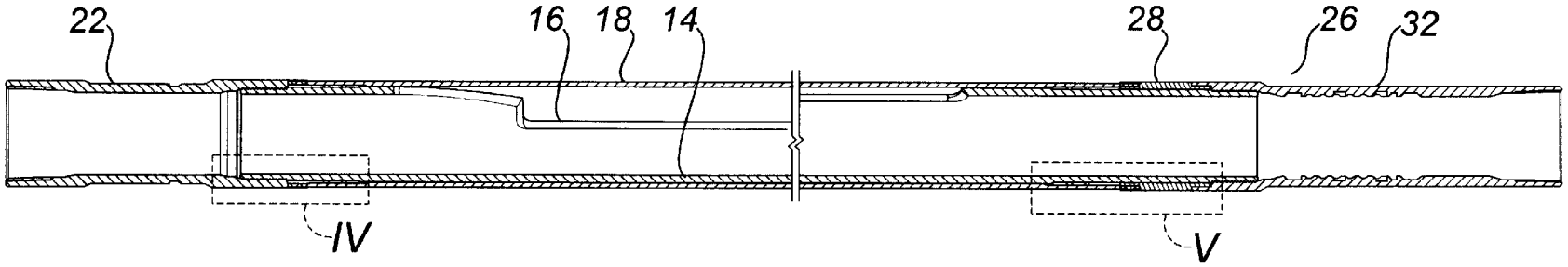
FIG. 2 is a longitudinal sectional view of the pressure sleeve positioned over the pre-cut window formed in a section of the casing.
Figure 3:
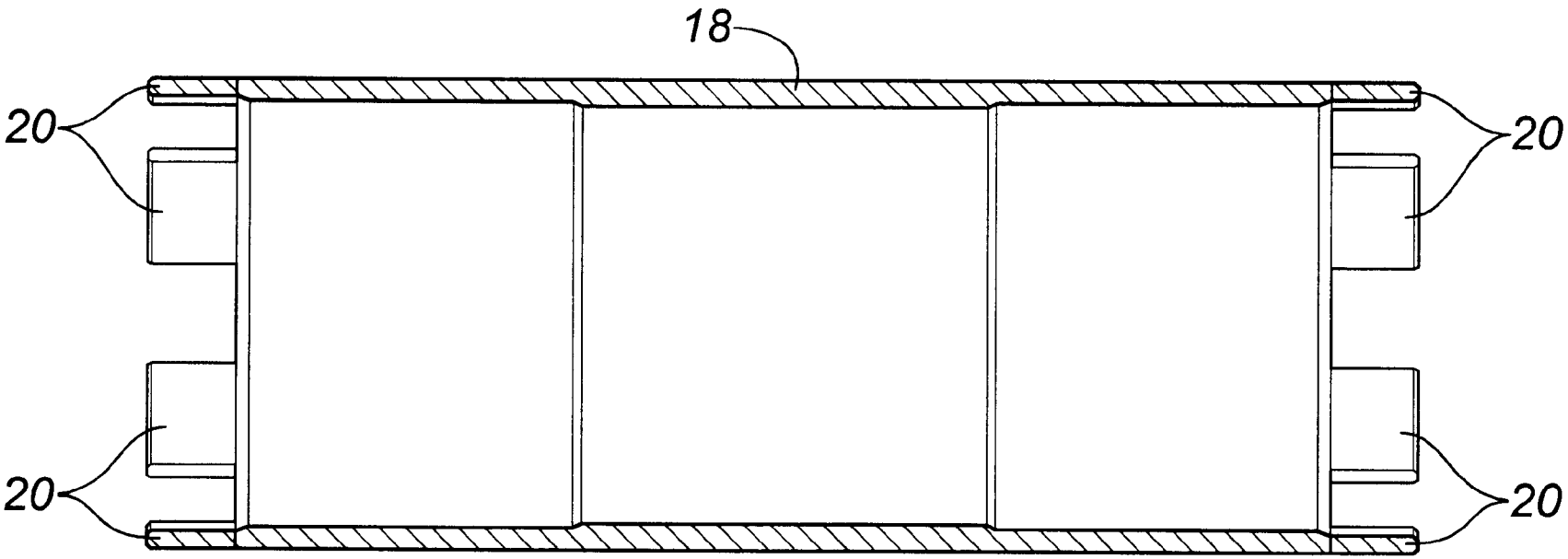
FIG. 3 is a longitudinal view of the pressure sleeve.

Referring now to FIG. 2, there is illustrated a section of the casing 14 having a window 16 pre-cut therein. Concentrically disposed on the casing 14 and adjacent the window 16 is the generally cylindrical sleeve member 18, also illustrated in FIG. 3. The sleeve 18 is constructed of an easily drillable material. In the preferred embodiment, the sleeve 18 is constructed of aluminum. Both end regions of the sleeve 18 have a number of protrusions or teeth 20, which are angularly spaced from each other about the longitudinal central axis of the sleeve 18.

Figure 6:
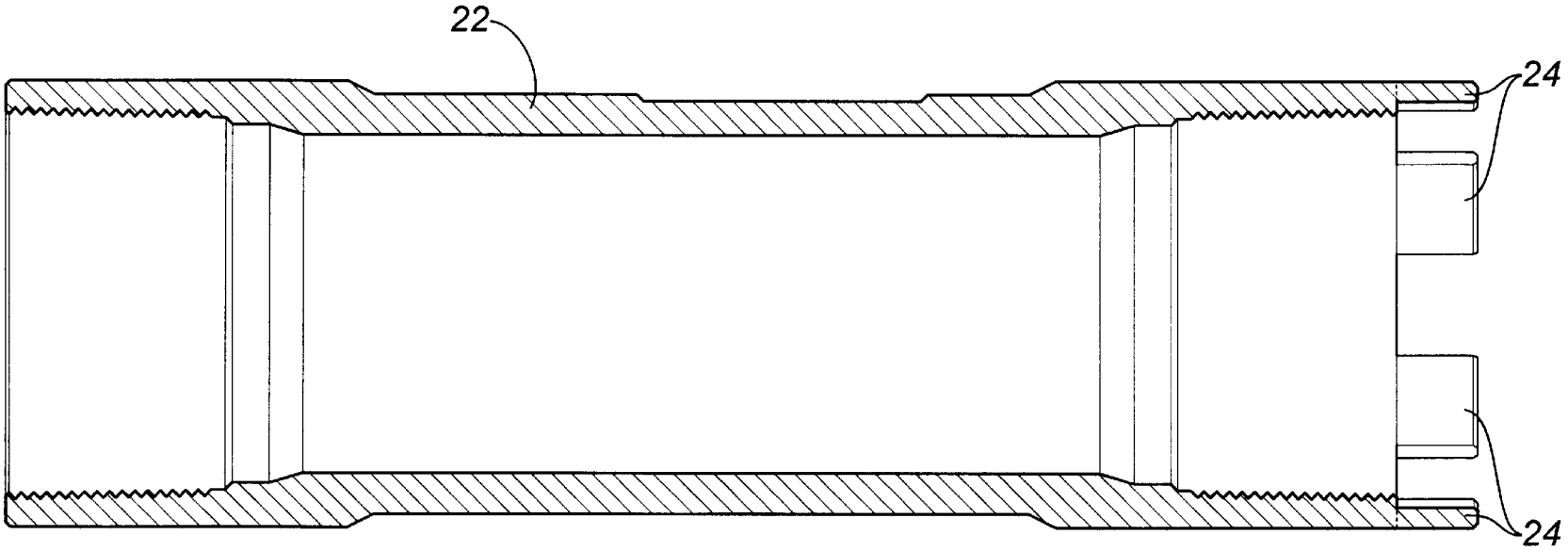
FIG. 6 is a longitudinal view of the coupling member connecting the casing window section to the upper casing string.
Figure 7:
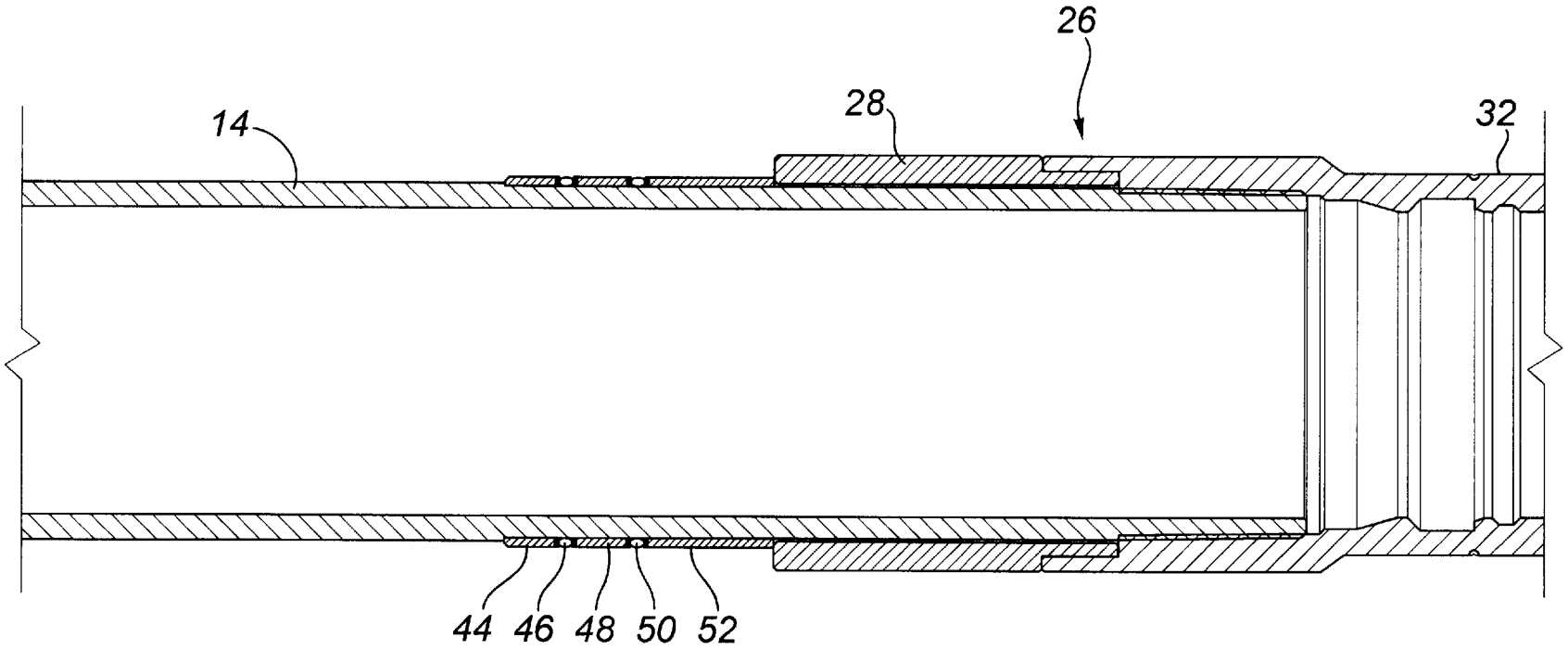
FIG. 7 is a partial longitudinal view of the of the coupling assembly connecting the casing window section to the lower casing string.

As shown in FIG. 2, the upper end of the sleeve 18 is mechanically coupled to a coupling member 22 by means of a mechanical interlocking coupling comprised of the complimentary protusions or teeth 24 extending from the coupling member 22, illustrated in greater detail in FIG. 6, which are angularly spaced from each other about the longitudinal central of the coupling member 22 and complimentary to the protusions 20 extending from the sleeve 18. The lower end of coupling member 22 is adapted to be connected by a threaded joint to the upper end of the window casing section 14. The upper end of the coupling member 22 is adapted to be connected by a treaded joint into the casing string. Likewise, the lower end of the sleeve 18 is mechanically coupled to a coupling assembly 26 by means a mechanical interlocking coupling. The coupling assembly 26, the upper portion of which is illustrated in greater detail in FIG. 7, comprises a coupling ring 28 having complimentary protusions or teeth 30 extending from the coupling ring 28, which are angularly spaced from each other about the longitudinal central axis of the coupling ring 28 and complimentary to the protrusions 20 extending from the sleeve 18. The lower end of the coupling ring 28 is rotatable within the upper end portion of the lower coupling member 32. The upper end of the coupling member 32 is adapted to be connected by a threaded joint to the lower end of the window casing section 14. The lower end of the lower coupling member 32 is adapted to be connected by a threaded joint into the casing string.

Figure 5:
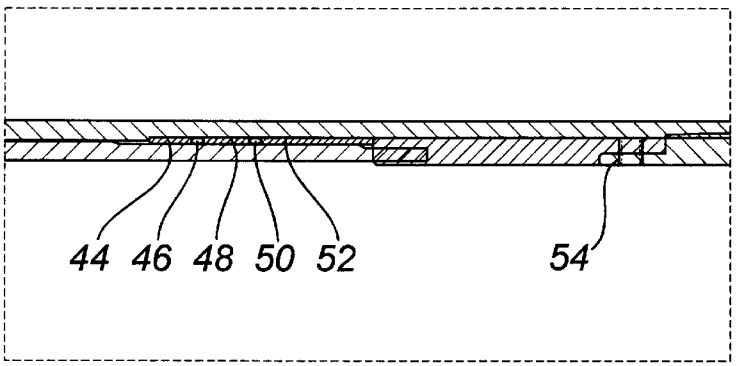
FIGS. 4 and 5 are longitudinal sectional views of a portion of the end coupling connections of the pressure sleeve.
Figure 4:
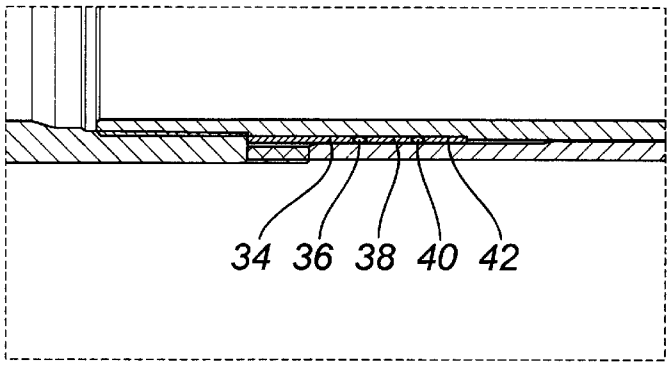

Referring now to FIG. 4 there is illustrated in greater detail a portion of the upper connection of the sleeve 18 to the coupling member 22. To provide a pressure seal between the well 10 and the inside of the casing 14, pressure seals are incorporated between the sleeve 18 and the casing 14. The upper pressure seal comprises the metal spacer ring 34, the 0-ring 36, the metal spacer ring 38, the 0-ring 40 and the metal spacer ring 42. Likewise, referring to FIG. 5, adjacent the lower connection of the sleeve 18 to the coupling ring 28 a pressure seal between the well 10 and the inside of the casing 14 is provided. This pressure seal comprises the metal spacer ring 44, 0-ring 46, metal spacer ring 48, 0-ring 50 and metal spacer ring 52. When assembled, the coupling ring 28 is fixed to the lower coupling member 32 by a plurality of pins 54 spaced equally about the coupling ring 28 preventing rotation of the coupling ring 28, and thus the sleeve 18, in relation to the casing 14. Thus, when fully assembled the sleeve 18 provides a pressure seal over the window 16, as well as providing the ability for torque to be transmitted through the casing string.

Referring again to FIG. 2, the process of assemble of the casing window section of the present invention is described. First, the lower coupling assembly 26 is threadably connected to the lower end of the casing section 14 and the lower pressure seal, comprising metal spacer rings 44, 48 and 52 and O-rings 46 and 50, and the upper pressure seal, comprising metal spacer rings 34, 38 and 42 and O-rings 36 and 40, are installed. The sleeve 18 is installed concentrically on the casing section 14 covering the window 16 formed therein. Next the coupling member 22 is threadably installed and torque in applied to approximately 12,500 foot pounds. When complete, coupling ring 28 and lower coupling member 32 are fixed by installing a plural of pins 54.

A window covering of a composite material, such as fiberglass, as taught in the prior art is capable of withstanding a torque of approximately 3,000 foot-pounds for a 7 inch casing. In contrast, the apparatus of the present invention is capable of withstanding a torque up to, and in excess of 17,000 foot-pounds for a 7 inch casing. It should also be recognized that the pressure sleeve of the present invention is installed without means of welding. Welding of a metal window cover constructed of an easily drillable alloy poses several problems. The alloy may crack due to the high heat from welding or the alloy window cover may warp as a result of welding. The unique mounting system of the present invention avoids these problems.

Thus, there bas been described herein the preferred embodiment of a system for maintaining the pressure integrity of a casing joint having an easily drillable exit port which is capable of withstanding torque encountered when installing casing in a well. However, the invention is to be constructed most broadly and to be limited only by the appended claims.

What is claimed is:

1. A casing string including a casing assembly for use in drilling lateral boreholes, the casing assembly comprising:

a joint of tubular casing having a central passage and a drill bit exit port in the lateral wall thereof for receiving a drill bit extending from said central passage; and a tubular sleeve fixedly disposed concentrically on said joint of tubular casing adjacent said exit port, wherein said sleeve is fixedly coupled in said casing string at an upper end and a lower end of said joint of said tubular casing to couple torque applied to said casing string.

2. The casing string according to claim 1, wherein said casing assembly further comprises seals for sealing the inner surface of said sleeve against the outer surface of said tubular casing.

3. The casing string according to claim 2, wherein said seals further comprise seals on opposite sides of said exit port.

4. The casing string according to claim 1, wherein said sleeve of said casing assembly further comprises an easily drillable material.

5. The casing string according to claim 4, wherein said easily drillable material comprises aluminum.

6. The casing string according to claim 1, wherein said casing assembly further comprises mechanically interlocking couplings operably associated with both said sleeve and said casing string for mechanically transferring torque from said casing string to said sleeve.

7. The casing string according to claim 6, wherein said mechanically interlocking couplings are comprised of an upper coupling mechanically transferring torque between said casing string and said sleeve adjacent said upper end of the joint of tubular casing and a lower coupling mechanically transferring torque between said casing string and said sleeve adjacent said lower end of said joint of tubular casing.

8. A system for drilling a lateral well with respect to a main well, comprising:

a well casing string including a section of casing having a lateral opening therein, said lateral opening adapted to allow passage of a drill string; and an easily drillable sleeve located concentrically on the outside of said section of casing adjacent said lateral opening, the inner surface of said sleeve being sealed against the outer surface of said casing string; and mechanical couplings for locking each end of said sleeve with said casing string for common torsional movement in response to torque on said casing string.

9. The system for drilling according to claim 8, wherein said inner surface of said sleeve is scaled against the outer surface of said casing string on opposite sides of said lateral opening.

10. The system for drilling according to claim 9, wherein said easily drillable sleeve comprises an aluminum sleeve.

11. The system for drilling according to claim 8, wherein said mechanical couplings further comprise mechanically interlocking couplings associated with both said sleeve and said casing string for mechanically transferring torque between said sleeve and said casing string.

12. The system for drilling according to claim 11 wherein said mechanically interlocking couplings are comprised of an upper coupling mechanically transferring torque between said casing string and said sleeve adjacent an upper end of said section of casing and a lower coupling mechanically transferring torque between said casing string and said sleeve adjacent a lower end of said section of casing.

13. A system for drilling a lateral well from a main well, comprising:

a well casing string having a section of casing string with a lateral opening therein;

an easily drillable sleeve located concentrically on the outside of said section of casing string adjacent said lateral opening, the inner surface of said sleeve being sealed against the outer surface of said section of casing string; and mechanical couplings for locking said sleeve to said casing string on opposite ends of said section of casing string and lateral opening for mechanically transferring torque between said sleeve and said casing string.

14. The system for drilling according to claim 13, wherein said mechanical couplings further comprise mechanical interlocking couplings for locking each end of said sleeve to said casing string to prevent relative rotation there between.

15. The system for drilling according to claim 14 wherein said mechanically interlocking couplings are comprised of an upper coupling mechanically transferring torque between said casing string and said sleeve adjacent an upper end of said section of casing string and a lower coupling mechanically transferring torque between said casing string and said sleeve adjacent a lower end of said section of casing string.

* * * * *